United States Patent [19]

Douglass

[11] Patent Number: 5,042,702

[45] Date of Patent: Aug. 27, 1991

[54] CARRYING DEVICE

[76] Inventor: Emory J. Douglass, 5208 Pine St., Bellaire, Tex. 77401

[21] Appl. No.: 442,381

[22] Filed: Nov. 27, 1989

Related U.S. Application Data

[63] Continuation of Ser. No. 193,911, May 13, 1988, abandoned.

[51] Int. Cl.[5] ..... A45F 3/14

[52] U.S. Cl. ..... 224/208; 224/901

[58] Field of Search ..... 224/222, 224, 253, 901, 224/904, 202, 208, 211, 215, 216, 252, 262, 267, 907; 206/315.3; 273/32 R, DIG. 30; 2/DIG. 6

[56] References Cited

U.S. PATENT DOCUMENTS

| | | | |
|---|---|---|---|
| 4,079,871 | 3/1978 | Sica | 224/919 X |
| 4,140,253 | 2/1979 | Vickers et al. | 2/DIG. 6 X |
| 4,182,470 | 1/1980 | Atkinson | 224/183 |
| 4,433,803 | 2/1984 | Liberboim | 224/251 |
| 4,715,839 | 12/1987 | Ford et al. | 446/28 |
| 4,747,527 | 5/1988 | Trumpower, II | 224/224 |

*Primary Examiner*—Henry J. Recla
*Assistant Examiner*—Robert M. Fetsuga
*Attorney, Agent, or Firm*—Kurt S. Myers

[57] ABSTRACT

The present invention is directed to a carrying device which comprises an object to be carried, a strip of "Velcro" material affixed to the outside of the object, a belt member adapted to be worn around a person's waist, the belt member having a weight bearing supporting section which extends across the small of the back, and a second strip of "Velcro" material affixed to the outside of that supporting section of the belt member.

6 Claims, 1 Drawing Sheet

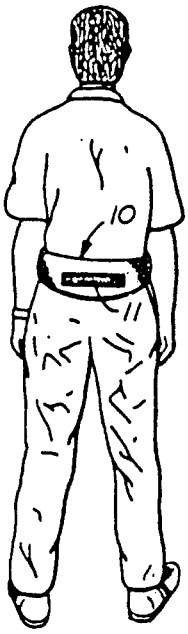
FIG. 1
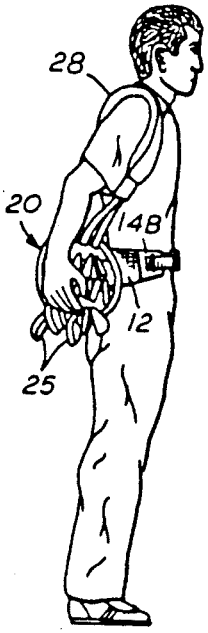
FIG. 5
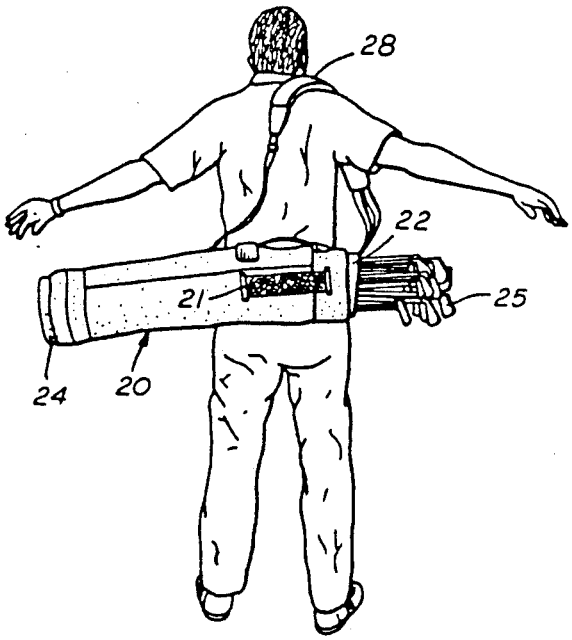
FIG. 6
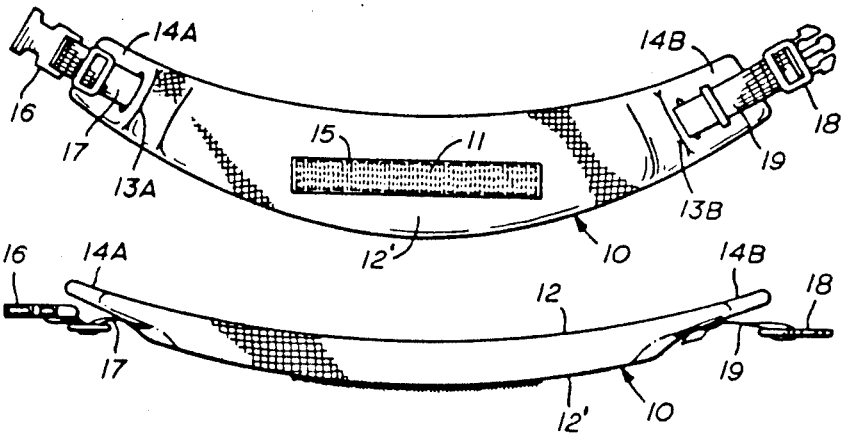
FIG. 2
FIG. 3
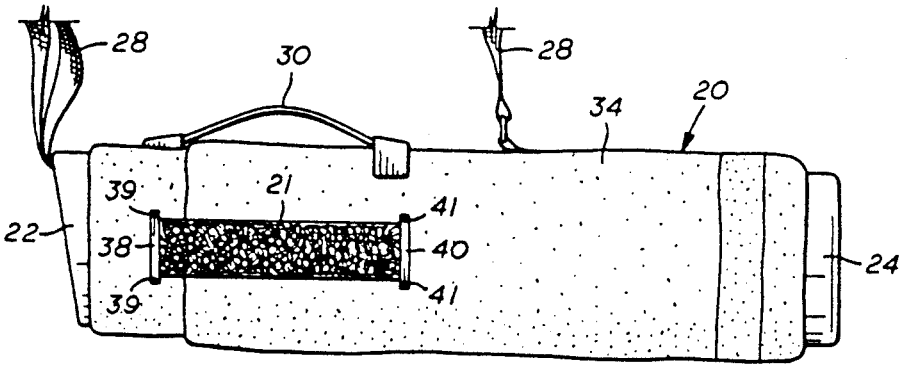
FIG. 4

CARRYING DEVICE

This is a continuation of application Ser. No. 07/193,911, filed May 13, 1988 entitled "Carrying Device," now abandoned.

BACKGROUND OF THE INVENTION

This invention relates to a carrying device. More specifically, the present invention is directed to a heavy object to be carried, such as a golf bag, having a strip of thistle cloth ("Velcro") affixed to one side, and a belt member which is adapted to be worn around a person's waist having a second strip of thistle cloth affixed to the outside of the belt member across the lower back so as to place the weight of the object in the pelvic region when the thistle cloth strips are joined.

U.S. Pat. No. 4,182,470 discloses a carrying device which comprises a belt which is adapted to be worn around a person's waist and which has attached thereto at least one magnetic member, the magnetic member being able to hold metallic objects by magnetism. A specific device is a golf bag having a belt holding a magnet which will attach to the magnet on the belt. The disadvantage of magnets are that the magnets themselves add weight and, secondly, that they only attract when they are positioned in essentially one fixed position or else they repel. Also, once that they are magnetically attracted, one to another, they are difficult to separate.

U.S. Pat. No. 4,029,243 discloses a backpack integrated into a weight supporting belt. The fastener for the belt is made of "Velcro" material so that the fastener is adjustable. The "Velcro" strips are on the free ends of the belt.

U.S Pat. No. 4,625,862 discloses an accessory support for use with a golf bag which comprises a "Velcro" strip. The corresponding strip is attached to golf club covers or to other accessories for attachment to the golf bag.

In the approaches used by the prior art, the use of "Velcro" strips is not used as a supporting structure for carrying an object and transferring the weight of the object from the back and shoulders to the hips or pelvic region of a person or from one shoulder to a more centered position for easier carrying.

SUMMARY OF THE INVENTION

The present invention is directed to a carrying device which comprises an object to be carried, a strip of "Velcro" material affixed to the outside of the object, a belt member adapted to be worn around a person's waist, the belt member having a weight bearing supporting section which extends across the small of the back, and a second strip of "Velcro" material affixed to the outside of the supporting section of the belt member.

Further advantages of the invention will be set forth in more detail and a preferred mode of the invention will be set forth in the following detailed description.

BRIEF DESCRIPTION OF THE DRAWINGS

FIG. 1 discloses a belt member of the present invention which is worn around a person's waist;

FIG. 2 is a plan view of the belt member of the present invention;

FIG. 3 is a top view of the belt member of the present invention;

FIG. 4 is a side view of the golf bag having a strip of thistle cloth affixed to the side of the golf bag according to the present invention;

FIG. 5 discloses a golf club and accessories supporting device according to the present invention which includes the golf bag and the belt member worn around the person's waist; and FIG. 6 discloses the golf bag being supported on the belt of a person wearing the belt around their waist.

DESCRIPTION OF THE INVENTION

The present invention is a carrying device which comprises a belt member 10, an object 20 (a sport's object such as a golf bag or an arrow quiver) and strips of thistle cloth 11 and 21 respectively, on the belt member 10 and object 20. The strips of thistle cloth 11 and 21 ar the two pieces of a "Velcro" brand fastening system manufactured by Velcro U.S.A., Inc. With the Velcro fastening system, the thistle cloth is of two types, one, referred to as a thistle cloth pile material which has a shorter, even thistle and the other referred to as a thistle cloth hooks material with a longer, uneven ended (rough) thistle. It is understood that for definition herein, "a strip of thistle cloth" may be either one or the other type of material; however, "the second strip of thistle cloth" is then understood to be the opposite of the types of material. For example, when a strip of thistle cloth 11 is the thistle cloth hooks material used on the belt 10, then the "second strip of thistle cloth" will be the thistle cloth pile material and will be on the object 20. The thistle cloth hooks material has a greater propensity to attach to any kind of substance. Since the belt 10 will be worn, it is preferred to use the thistle cloth hooks material on the belt 10 since it not as likely to contact and thus pick up material on the ground such as leaves or the like or to attach to the person's shirt as it would if used on the object such as a golf bag. It is understood, however, that the types of thistle cloth may be reversed and the thistle cloth pile material can be used on the Belt 10

The attachment of the object 20 to the belt 10 is provided by the "Velcro" fastening system. The area of the "Velcro" surfaces for attachment is governed by the weight of the object to be carried. For a golf bag, which may weigh from 25 to 40 pounds, the strip 11 on belt 10 may have a width of one (1") inch and a length of four (4") inches. The strip 21 on golf bag 20 may have the same or larger dimension strips than strip 11. For ease of positioning, however, both strip 11 and strip 21 may be from about 1¼" to 4" wide and 6" to about 12" long.

Referring to FIGS. 1, 2 and 3, a belt member 10 which is worn around the person's waist provides the basic supporting structure. The belt member 10 has a supporting section 12 which extends across the small of the back of the person and around to the front of the person where it terminates at 13A and 13B. The support section 12 of belt number 10 is worn above the hips and is properly fitted when it extends so as to cover the hip bones in order to support the weight of the pelvic region of the person Referring now to FIGS. 2 and 3 illustrating one preferred embodiment, the belt member 10 has a supporting section 12 which preferably has an enlarged portion 12', which is a thicker portion that extends across the back of the person when the belt 10 is worn. The belt member 10 additionally has an adjustable securing portion or member 14A, 14B. The strip 11 is affixed to the supporting section 12 of belt 10 so as to be positioned across the small of the back of the person. The strip 11 is affixed to supporting section 12 in a number of ways, either by sewing or stitching them or by separate affixing means such as brads or staples or the like. The strips 11 are preferably affixed to belt 10 by sewing or stitching 15. Attached to the adjustable securing portion 14A may be a buckle 16 attached by an adjustable belt 17. On the other end of belt member 10, is a clip 18 for inserting into buckle 16 which is also attached by an adjustable belt 19. The specific securing portion need not be a buckle and clip but any securing portion to secure the belt 10 around the person's waist with the supporting section 12 snug to the pelvic region of the person. For example, the adjustable securing portion 14A, 14B may be the adjustable fastener means disclosed in U.S. Pat. No. 4,029,243. The supporting section 12 is the weight bearing portion of the carrying device of the present invention.

Referring now to FIG. 4, a object 20 of the present invention may be a golf bag. The carrying device of the present invention is applicable to the objects such as a quiver or a gun. The golf bag 20 has an open end 22 and a closed end 24. The golf clubs 25 are inserted into the open end 22 with the heads of the clubs extending out of the golf bag 20. The golf bag 20 has a shoulder strap 28 affixed thereto, usually with one attachment point near the open end 22 of the golf bag 20 and the other attachment point further down the bag 20. Also attached to the bag 20 is a handle 30. The golf bag 20 may have many shapes such as cylindrical or rectangular. Affixed to at least one side 34 of the golf bag 20 is a strip of thistle cloth 21 which is preferably a strip of thistle cloth pile. This strip of thistle cloth 21 may be affixed to the golf bag in a number of ways, either by stitching, gluing or by a separate affixing means. Illustrated in FIG. 4, the strip 21 is held by strips 38 and 40 which are affixed to the golf bag 20 by brads 39 and 41, respectively. The strip 21 is usually as wide and long as strip 11.

As shown in FIGS. 4 and 6, the golf bag 20 has a strip of thistle cloth 21 affixed to either side below the carrying strap 28 and handle 30 of bag 20. A golfer usually lifts the bag 20 by the strap 28 and positions the bag 20 above the belt 10 and lowers the bag 20 to be supported by the belt member 10 when the two strips of thistle cloth 11 and 21, respectively come into engagement (FIG. 5). The engagement is easily accomplished since the strip of thistle cloth 21 on the bag 20 need only to engage the strip of thistle cloth 11 on the belt 10. The evening of the weight of the golf bag 20 meaning having about the approximate weight on one side of the person as the other, is naturally accomplished when the bag 20 is lowered to contact the belt 10. The bag 20 is further easily affixed since there is no need for any exact placement of the bag 20 with respect to the belt 10 in that there is sufficient thistle cloth, both on the bag and on the belt, for attachment and support by the belt 10. As is illustrated in FIG. 6, there is sufficient support between the strip of thistle cloth 21 on the bag and the strip of thistle cloth 11 on the belt 10 so that the carrying strap 28 need not support any weight or very little weight.

The present invention will now be illustrated in greater detail by way of a specific example, but it should be understood that this example is not limiting of the present invention.

EXAMPLE

A belt having the shape shown in FIG. 2 with a supporting section having the following dimensions:

length: $24\frac{1}{2}''$
widest width: $5''$
thickness: $\frac{3}{4}''$ has a "Velcro" strip sewn to the supporting section and centered thereon having a dimension $1\frac{1}{4}'' \times 10''$.

A golf bag weighing approximately 25 pounds has a "Velcro" strip having a dimension $2'' \times 10''$ was sewn to the bag.

The thistle cloth strip sewn to the belt was a thistle cloth hooks material and that sewn to the bag was a thistle cloth pile material. The "Velcro" was identified Loop 1000/Hook 80 Black #330,0140.

The carrying device of this example has supported the golf bag and has provided easy attachment and removal. The belt is continuously worn during the round of golf with no detriment to the golfer's swing.

The ease of attachment and removal is important for a golf bag; however, if repeated attachment and removal is not required, a pair of strips of thistle cloth with greater bond strength may be used. Further, if the use requires substantial attachment and removal, then the strips of thistle cloth may be attached to the belt or object in a manner such as to be replaceable, such as by snaps or a zipper.

It is to be appreciated that the embodiment of the invention described above has been given by way of example only and that various modifications may be made. The scope of the invention is therefore to be limited only by the attendant claims.

I claim:

1. A carrying device comprising:

a golf bag to be carried;

a strip of thistle cloth affixed to the outside of said bag:

a belt member having two ends which is worn around a person's waist with the two ends affixed at the front of the person, said member having a weight bearing section which extends across the small of the back;

said member having an inside which contacts the person and an outside; and a second strip of thistle cloth affixed to the outside of said belt member and on that portion of said weight bearing section which extends across the small of the back, said size and shape of said second strip being in contact with the thistle cloth affixed to said bag to provide the sole support of said bag on said belt member.

2. A carrying device according to claim 1 wherein said thistle cloth affixed to said golf bag is a strip of thistle cloth pile.

3. A carrying device according to claim 1 wherein said thistle cloth affixed to said golf bag is a strip of thistle cloth hooks.

4. A carrying device according to claim 1 wherein said thistle cloth affixed to said belt member is a strip of thistle cloth hooks.

5. A carrying device according to claim 1 wherein said thistle cloth affixed to said belt member is a strip of thistle cloth pile.

6. A carrying device according to claim 1 wherein said belt member further includes:

an adjustable securing member affixed to the ends of said belt member for attaching around the person's waist.

* * * * *